US007395815B2

(12) United States Patent
Tansuğ

(10) Patent No.: US 7,395,815 B2
(45) Date of Patent: Jul. 8, 2008

(54) FUEL INJECTION PUMP

(75) Inventor: Onur Mehmet Tansuğ, Izmir (TR)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/714,589

(22) Filed: Mar. 6, 2007

(65) Prior Publication Data

US 2007/0217926 A1 Sep. 20, 2007

(30) Foreign Application Priority Data

Mar. 6, 2006 (EP) ..... 06251186

(51) Int. Cl.
*F02M 37/04* (2006.01)
*F02M 37/06* (2006.01)

(52) U.S. Cl. ..... 123/503; 123/446

(58) Field of Classification Search ..... 123/502, 123/501, 446, 503, 495, 500; 137/50, 331; 417/494, 499
See application file for complete search history.

(56) References Cited

U.S. PATENT DOCUMENTS 4,721,442 A * 1/1988 Tanaka ..... 417/499
5,171,133 A * 12/1992 Thomas ..... 417/499
6,619,186 B2 * 9/2003 Duquette et al. ..... 92/60.5

FOREIGN PATENT DOCUMENTS

| | | |
|---|---|---|
| DE | 19719265 | 11/1998 |
| DE | 10140420 | 3/2003 |
| EP | 0285194 | 10/1988 |
| GB | 2170558 | 8/1986 |
| GB | 2198793 | 6/1988 |

* cited by examiner

*Primary Examiner*—Mahmoud Gimie
(74) *Attorney, Agent, or Firm*—David P. Wood

(57) ABSTRACT

The invention provides a fuel injection pump comprising a pump housing and a pumping arrangement associated therewith, wherein the pumping arrangement includes a pumping plunger and a plunger drive arrangement, the pumping plunger having a first end reciprocably received within a plunger bore provided in the pump housing and a second end coupled to the plunger drive arrangement. A biasing spring is provided having first and second spring ends, the first spring end coupled to a spring plate member associated with the pump housing and the second spring end coupled the plunger drive arrangement. The pump housing includes first and second portions aligned on a common axis, the upper portion including a further bore in which at least an upper portion of a locking pin is receivable and wherein the spring plate member defines support means for supporting a lower end portion of the locking pin.

13 Claims, 5 Drawing Sheets

FUEL INJECTION PUMP

TECHNICAL FIELD

This invention relates to a fuel injection pump, and particularly a fuel injection pump suitable for use with a compression-ignition internal combustion engine.

BACKGROUND TO THE INVENTION

FIGS. 1A and 1B show perspective and cross section views, respectively, of a known fuel injection pump, indicated generally as 2, which is suitable for use as a means of supplying pressurised fuel to a fuel injector of an internal combustion engine. The fuel pump 2 includes a generally tubular pump housing 4 having an axially disposed bore 6 within which a pumping plunger 8 is slidable. The pumping plunger 8 has a lower end 10 (in the orientation shown in FIG. 1) that is coupled to a drive arrangement 12 for transmitting reciprocating motion to the plunger 8. The drive arrangement 12 includes a tappet body 14 and an associated cam roller 16 on which a cam member acts, in use (the cam member itself is not shown). A biasing means in the form of a helical spring 17 is received over the plunger 8 such that the spring 17 is disposed between the pump housing 4 and the tappet body 14. An upper end 18 of the biasing spring 17 abuts a spring plate 20 attached to a lower end of the pump housing 4 and a lower end 22 of the spring 17 abuts the tappet body 14, the spring 17 thus serving to bias the plunger 8 downwards in the orientation shown.

As shown in FIG. 1B, an upper end of the pump housing 24 defines a cup-shaped recess 26 into which a lower end of an outlet valve 28 is received. The lower end of the outlet valve 28 closes off the plunger bore 6 and defines a pressurisation chamber 30 between it and the upper end of the plunger 8.

In use, the cam member drives the plunger 8 via the drive arrangement 12 on a pumping stroke during which fuel within the chamber 30 is pressurised. When the pressure of fuel within the pumping chamber 30 reaches a predetermined pressure, the outlet valve 28 opens to permit pressurised fuel to flow through the outlet valve 28. Although not shown in FIGS. 1A and 1B, a fuel conduit may be attached to the outlet valve 28 to convey fuel to a fuel injector, for example.

As the cam member rotates further, the pumping plunger 8 passes a top dead centre position and thus commences a return stroke under the force of the spring 17. During the return stroke, fuel is permitted to fill the pumping chamber 30 through a fill/spill port 32 which is connected to a source of fuel at a relatively low pressure.

In order to vary the delivery volume of the fuel pump 2, the pumping plunger 8 is provided with a control arm 40 which extends radially away from the approximate mid point of the plunger 8. Angular movement of the control arm 40 varies the angular position of the pumping plunger 8.

In use, the control arm 40 engages a fuel delivery rack (not shown) via a control pin 42 that depends downwardly from a radially outer end of the control arm 40. The position of the fuel delivery rack is determined by the engine governor and the rack, in turn, acts on the control arm 40 to cause radial movement of the pumping plunger 8 about its longitudinal axis. The radial position of the pumping plunger 8 determines the point of the pumping stoke that a spill helix 41 (not shown on FIG. 1A) registers with the low pressure spill port 32, thus terminating fuel pressurisation earlier, or later, in the pumping stroke depending on the degree and direction of rotation of the pumping plunger 8. The radial position also controls the start of fuel pressurisation by registration of the upper surface of the pumping plunger 8 with the spill port 32. The variation of the effective stroke between the upper surface of the plunger 8 and the spill helix varies the fuel delivery to the associated engine.

Typically, a plurality of such fuel pumps 2 are installed into the cylinder block of an engine, one per cylinder. In order for the engine to run smoothly, the pumps 2 must be installed with the control arms 40 located in exact positions corresponding to a predetermined delivery setting, hereafter referred to the "reference position".

Due to production tolerances of the components of the fuel pump 2, each fuel pump 2 provides a given delivery volume with the pumping plunger 8 in a slightly different relative angular position. Thus, each fuel pump 2 is subject to a calibration process during manufacture in which the control arm 40 of each pump 2 is set into the correct position to provide a desired delivery at a given speed defined by a customer, for example an engine manufacturer. Once calibrated, the control arm 40 is locked into its reference position by a locking pin 44 associated with the pump. The locking pin 44 is received within a longitudinally extending bore 46 provided in the pump housing 4 that is approximately parallel to the longitudinal axis of the fuel pump 2.

As can be observed in FIGS. 1A and 1B, the locking pin 44 is supported along substantially its entire length except for its tip 48 that protrudes from the open lower end of the bore 46 to engage a depression or pit (not shown) provided in the control arm 40. It is desirable for the locking pin 44 to be supported close to the spring plate 20 in this way to avoid unwanted movement of the control arm 40 or bending of the locking pin 44 during the process of delivering the fuel pump 2 to a customer. Movement of the control arm 40 would affect the reference position of the control arm, thus negating the pump calibration exercise.

A problem with the above described arrangement is that due to assembly requirements, and the need to support the locking pin 44 along its length, the pump housing 4 is required to be manufactured with a lower portion 50 which is eccentric to an upper portion 52 of the pump housing 4, i.e. axially offset. The process of machining the pump housing 4 to include eccentrically disposed upper and lower portions is complicated and, therefore, expensive. Consequently, it is desirable to provide a fuel injection pump that confers the same advantages and packaging profile as the fuel pump of FIGS. 1A and 1B, but which may be manufactured more readily so as to reduce production effort and overall unit costs.

SUMMARY OF INVENTION

It is against the above background that the invention provides a fuel injection pump comprising a pump housing and a pumping arrangement associated with the pump housing wherein the pumping arrangement includes a plunger and a plunger drive arrangement, the plunger having a first end reciprocably received within a plunger bore provided in the pump housing and a second end coupled to the plunger drive arrangement. Further, the fuel injection pump is provided with a biasing spring having first and second spring ends, the first spring end coupled to a spring plate member associated with the pump housing and the second spring end coupled to the plunger drive arrangement. The pump housing includes first and second portions aligned on a common axis, the upper portion including a second bore in which at least an upper portion of a locking pin is received and wherein the spring plate member defines a support arrangement for supporting a lower end portion of the locking pin.

The invention confers a significant advantage in terms of manufacturing effort and the costs associated therewith. By virtue of the invention, the requirement to manufacture an eccentrically disposed lower end housing portion is avoided since an arrangement is provided to support the lower end of the locking pin on the spring plate.

An importance difference between the fuel injection pump of the invention and the prior art pump as described above with reference to FIG. 1 is that, in the invention, the first and second housing portions are disposed along a common axis. In other words, the first and second portions are substantially concentric with one another. It should be understood that this is not the case with the fuel injection pump of FIGS. 1A and 1B in which the configuration of the pump housing is in the form of two cylinders, one disposed eccentrically relative to the other.

In order to permit control of the fuel delivery volume of the fuel injection pump, the pumping plunger preferably includes a radially extending control arm, which is moveable back and forth to cause the pumping plunger to move angularly within its bore. The control arm is set to a predetermined reference position to provide the required fuel pump delivery setting.

In the preferred embodiment of the invention, the spring plate member takes the form of first and second axially spaced concentric annular members, each of which defines a respective aperture. Preferably, each aperture is centrally disposed and of circular form.

One of said apertures preferably has substantially the same diameter as the second housing portion so as to define a press fit therewith. This feature thus enables the spring plate member to be attached to the pump housing. Conversely, the aperture of the other annular member is smaller, having substantially the same diameter as the pumping plunger, so as to allow the plunger to pass slidably therethrough.

Preferably, the spring plate member includes a lateral slot defined between the first and second annular members through which the control arm of the pumping plunger extends. The slot therefore serves to guide angular movement of the control arm.

Although the spring plate member may be manufactured as a multi-part assembly, preferably it is a one-piece cast, or milled, component such that the first and second annular members are joined by an integral semi-circular wall.

In the preferred embodiment, the support arrangement is a further aperture provided in the spring plate member. Preferably the further aperture is formed on a rim of one of the annular members, the dimension of the aperture being selected such that the lower end portion of the locking pin may be inserted and retracted. Preferably, the aperture is formed on a lobed region of one of the annular members.

From a second aspect, the invention provides a spring plate member for use with a fuel injection pump as described above. It will be appreciated that preferred and/or optional features of the fuel injection pump of the first aspect of the invention may also be incorporated within the spring plate member of the second aspect of the invention, alone or in appropriate combination.

BRIEF DESCRIPTION OF DRAWINGS

Reference has already been made to FIGS. 1A and 1B of the drawings, which show perspective and sectional views of a known fuel injection pump. In order that the invention may be more fully understood, it will now be described with reference to the remaining drawings in which.

DETAILED DESCRIPTION OF PREFERRED EMBODIMENTS

Figure 2A:
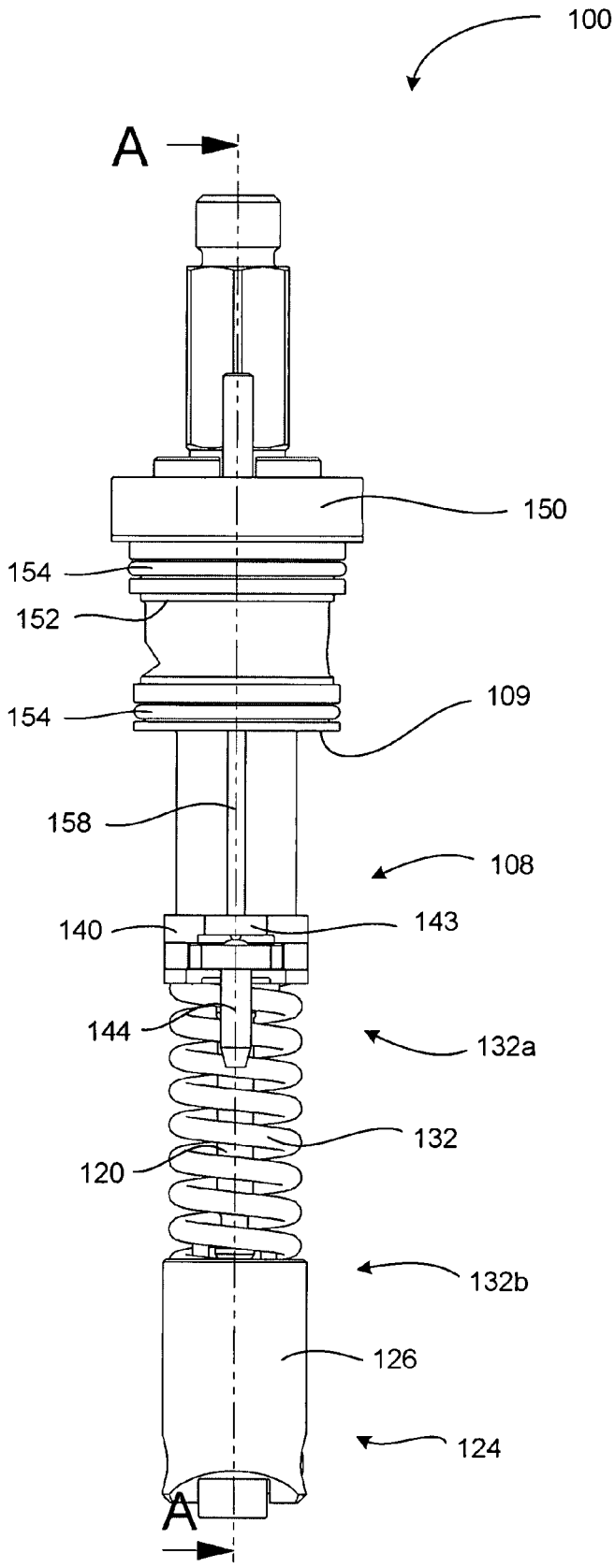
FIG. 2A is a side view of a fuel injection pump in accordance with an embodiment of the invention.
Figure 2B:
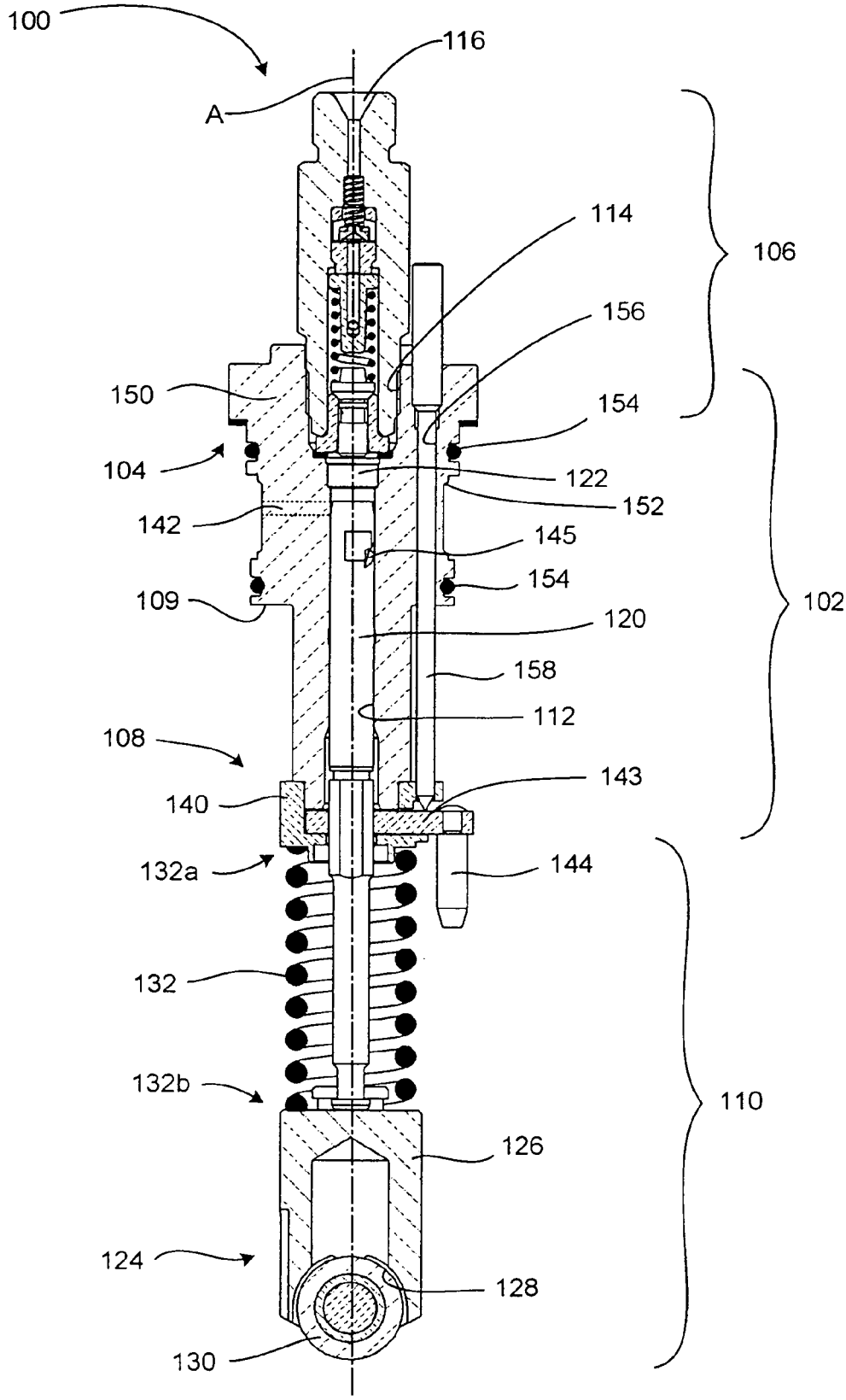
FIG. 2B is a cross section view of the fuel pump in FIG. 2A along the line A-A (the longitudinal axis of the fuel pump)

FIGS. 2A and 2B show a fuel injection pump 100 in accordance with the invention which comprises three main structural sections: a central pump housing 102; an outlet valve arrangement 106 connected to an upper, head region 104 of the pump housing 102; and a pumping arrangement 110 connected to a lower, neck region 108 of the pump housing 102.

The pump housing 102 has a generally tubular configuration and the two regions 104, 108 are separated by a shoulder 109. The pump housing 102 further includes a longitudinal through-bore 112 extending along its longitudinal axis 'A' which defines an opening at each end of the pump housing 102. It should be mentioned at this point that the terms 'upper' and 'lower' are used with reference to the orientation of the fuel injection pump 100 as shown in the drawings and, as such, are not intended to limit the fuel injection pump 100 to a particular orientation.

At an upper face of the head region 104, the bore 112 widens to define a cup shaped recess 114 that screw-threadingly receives a lower end of the outlet valve arrangement 106. The outlet valve arrangement 106 includes a pump outlet 116 which is connectable to a fluid conduit for the purposes of conveying pressurised fuel to an associated fuel injector (neither the fluid conduit nor the fuel injector are shown in FIGS. 2A and 2B). The function of the outlet valve arrangement 106 is to provide the fuel pump 100 with a delivery output at a predetermined pressure, although its structural details will not be described in further detail here.

The pumping arrangement 110 includes a pumping plunger 120, a portion of which is received within the pump housing bore 112 such that a pumping chamber 122 is defined within the bore 112 between an upper end of the pumping plunger 120 and a lower end of the outlet valve arrangement 106. The pumping plunger 120 defines a sliding clearance with the bore 112 such that it is able to reciprocate back and forth.

The pumping arrangement 110 also includes pump drive means 124 for driving the pumping plunger 120 in a reciprocating manner. The pump drive means 124 includes a tappet body 126 which is coupled to the lower end of the pumping plunger 120 and which defines a downwardly depending arch 128 shaped to receive a cam roller 130. Although not shown in the drawings, in use, the cam roller 130 is arranged to contact an engine-driven cam. As is known in the art, the engine driven cam provides a lobed cam surface that the cam roller 130 rides over as the cam rotates, to cause the pumping plunger 120 to reciprocate within the bore 112.

Figure 1A:
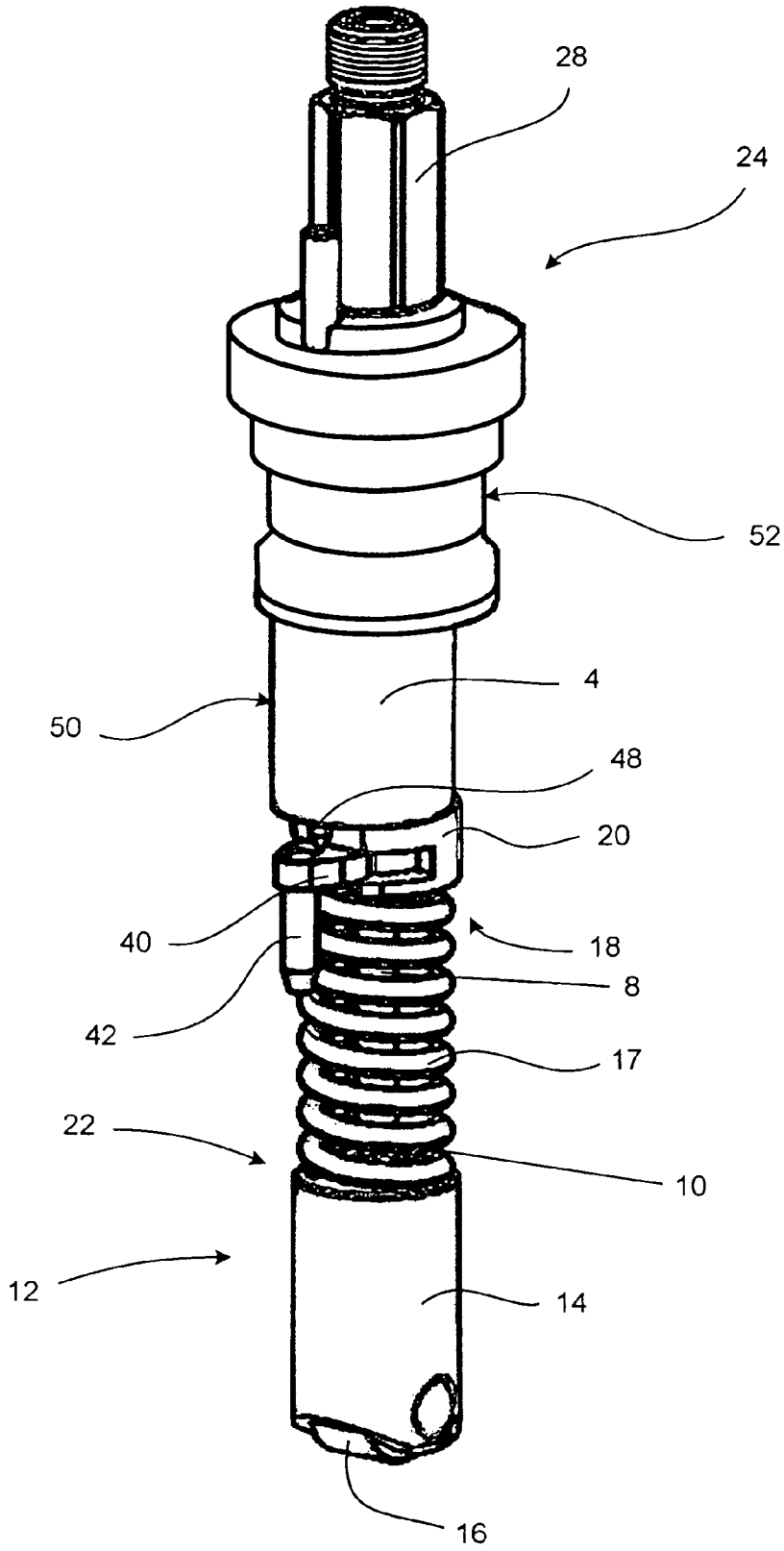
FIG. 1A PRIOR ART
Figure 1B:
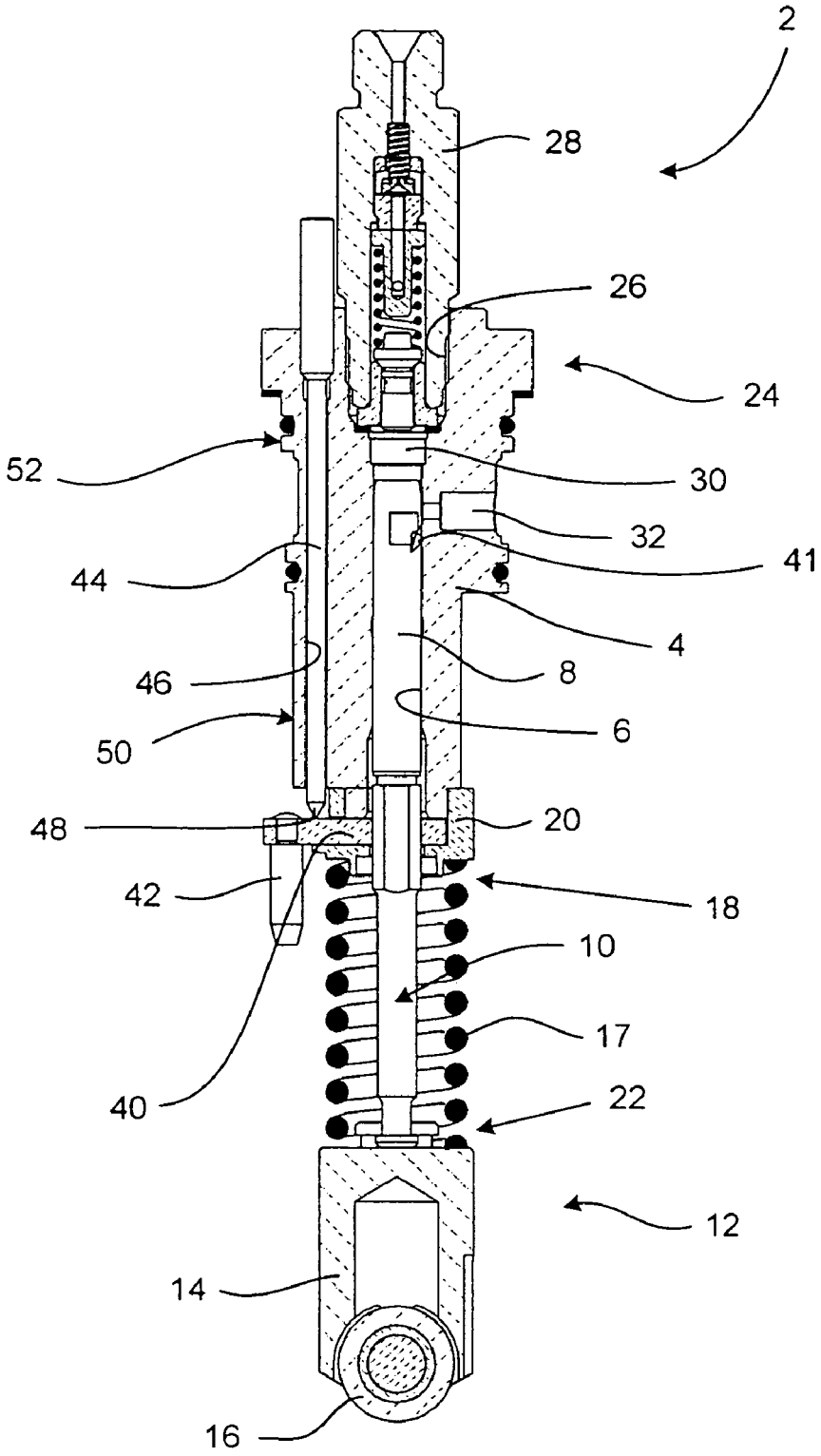
FIG. 1B PRIOR ART

In use, the pumping plunger 120 is driven on a pumping stroke during which fuel within the pumping chamber 122 is pressurised. When the pressure of fuel within the pumping chamber 122 reaches a predetermined pressure, the outlet valve 106 activates to permit pressurised fuel to flow through the pump outlet 116. Control over the fuel delivery quantity is determined by means of the effective pumping stroke, as described previously with reference to FIGS. 1A and 1B. Following a pumping stroke, the pumping plunger 120 will commence a return stroke.

In order to assist the pumping plunger 120 to perform a return stroke following a pumping stroke, the pump drive means 124 includes a plunger biasing means in the form of a helical spring 132 received over the pumping plunger 120 such that it is disposed between the pump housing 102 and the tappet body 126. An upper end 132*a* of the spring 132 abuts a spring plate member 140 attached to a lower end of the neck region 108 of the pump housing 102 and a lower end 132*b* of the spring 132 abuts the tappet body 126. It should be appreciated that although the spring 132 is shown abutting the spring plate member 140 and the neck region 108 in FIGS. 2A and 2B, other coupling arrangements are possible: for example, a spring abutment member (e.g. a washer or shim) may be interposed between the spring 132 and the neck region 108 and/or the spring 132 and the spring plate member 140. The spring 132 biases the pumping plunger 120 outwardly from the bore 112. During the return stroke, fuel is permitted to fill the pumping chamber 122 through a spill/fill port 142 which is connected to a source of fuel at a relatively low pressure, for example a low pressure displacement pump (not shown).

In order to vary the delivery volume of the fuel pump 100, the pumping plunger 120 is provided with a control arm 143 which extends radially away from an approximate mid-point of the plunger 120. A control pin 144 extends downwardly from the control arm 143 and serves to engage with a fuel delivery rack (not shown in FIGS. 2A and 2B) when the fuel pump 100 is in situ in an engine. The position of the fuel delivery rack is determined indirectly by the engine governor. Movement of the rack causes angular movement of the pumping plunger 120 about its longitudinal axis. The angular position of the plunger 120 determines the point of the pumping stoke that a spill helix 145 registers with the low pressure port spill/fill port 142, thus terminating fuel pressurisation.

Referring to the pump housing 102 in more detail, the head region 104 is provided with an outwardly projecting flange 150 at its uppermost end that serves to abut against a peripheral edge of a pocket formed in an engine cylinder block into which the head region 104 is received, in use (the engine cylinder block and the pocket are not shown in FIGS. 2A and 2B). The remaining length of the head region 104 is of substantially uniform diameter except for a radial recess 152 that constitutes a low pressure fuel gallery to which the spill/fill port 142 is connected. Two annular sealing rings 154 flank the radial recess 152, one on either side, the function of which is to define a close fit with the pocket so as to prevent fuel leaking from the recess 152 when the fuel pump 100 is in operation.

The head region 104 also includes a second through-bore 156 that is offset from the longitudinal axis A such that it extends approximately parallel thereto. A locking pin 158 is received by the bore 156 such that a lower portion of the locking pin 158 protrudes out of a lower bore opening defined in the shoulder 109. The protruding locking pin 158 extends adjacent the neck region 108 to terminate substantially in line with the lower end thereof. An upper end of the locking pin 158 extends from an upper bore opening defined in the upper face of the head region 104 and permits access to the locking pin 158 for insertion and removal.

It should be appreciated that the neck region 108 of the pump housing 102 is in coaxial alignment with the head region 104, along the longitudinal axis A. Put another way, the neck region 108 is concentrically disposed relative to the head region 104, thus sharing a common axis. This is to be compared with the known fuel pump 2 in FIGS. 1A and 1B in which the two housing portions are eccentrically disposed relative to one another. Arranging the head and neck regions 104, 108 concentrically realises a significant manufacturing advantage, as will be explained in further detail later.

Due to the concentric alignment of the head and neck regions 104, 108, the lower portion of the locking pin 158 is not guided by the pump housing 102 itself. However, to compensate for this, the spring plate member 140 is provided with support means for supporting, or guiding, the lower end of the locking pin 158.

Figure 3:
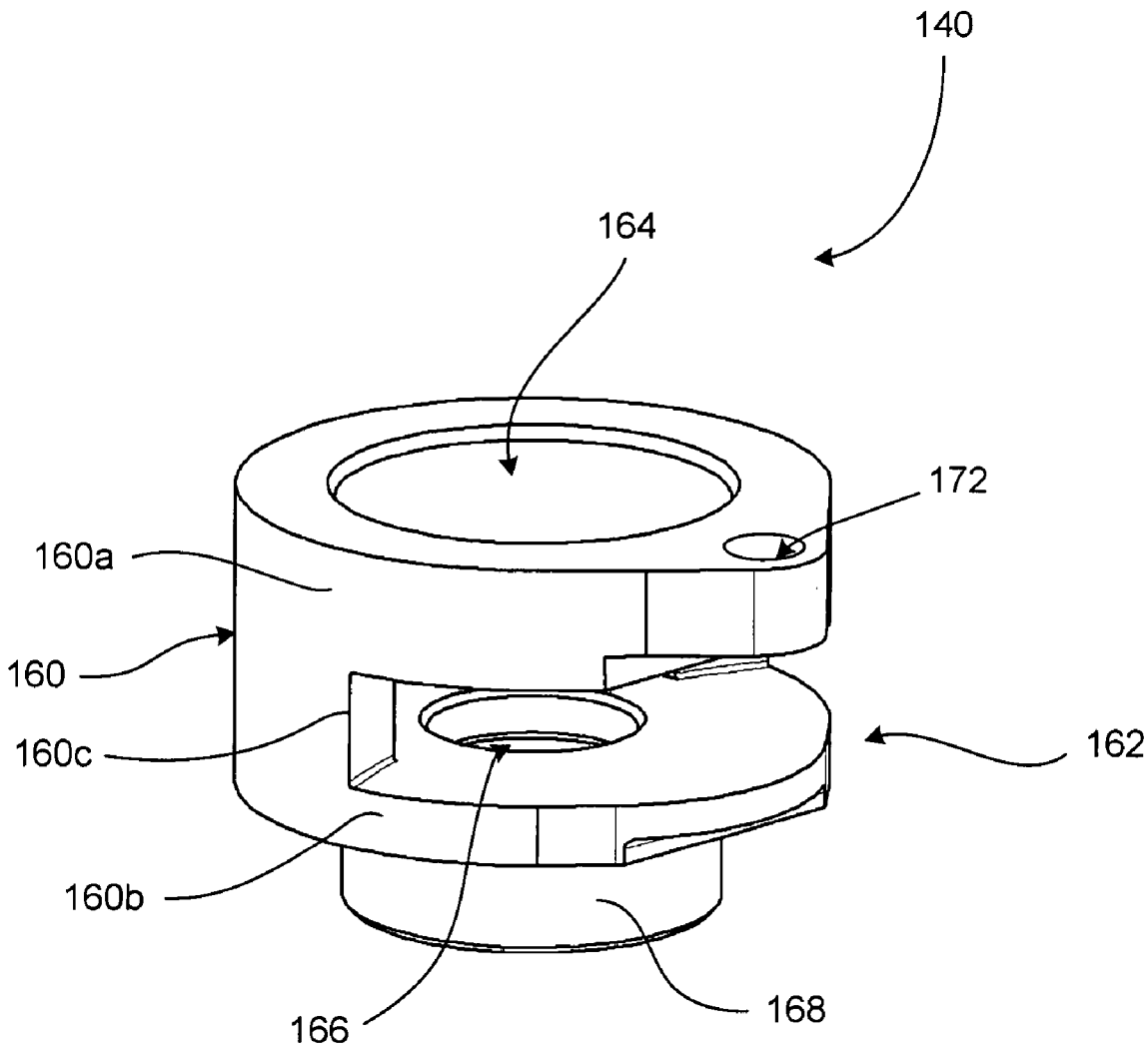
FIG. 3 is a perspective view of a spring plate member of the fuel injection pump in FIGS. 2A and 2B.

Referring also to FIG. 3, which shows the spring plate member 140 in more detail, the spring plate member 140 comprises a generally cylindrical body 160 except for a lateral cut-out region or slot 162, the depth of which is approximately half the diameter of the spring plate member 140. The formation of the slot 162 divides the spring plate member 140 into upper and lower annular members 160*a*, 160*b* joined by an integral semi-circular wall 160*c*. The control arm 143 affixed to the pumping plunger 120 extends radially outwards through the lateral slot 162 of the spring plate member 140. The shape of the slot permits the control arm 143 to move angularly about the axis A of the pumping plunger 120 by approximately 120 degrees, thus causing corresponding movement of the pumping plunger 120. Typically, however, the control arm 143 only needs to move through approximately 90 degrees in order to control fuel delivery between minimum and maximum settings.

The upper annular member 160*a* is provided with a central circular aperture 164 having a diameter that substantially corresponds to the diameter of the neck region 108 of the pump housing 102 such that the spring plate member 140 defines a press fit with the lower end of the neck region 108. It should be noted that although the aperture 164 is circular in this embodiment, this is only so that the aperture 164 is able to accommodate the lower end of the neck region 108, which is also circular. Accordingly, the aperture 164 could adopt another shape, if required, to accommodate a differently shaped neck region 108.

The lower annular member 160*b* is also provided with a central circular aperture 166, but which is smaller than the aperture 164, such that its diameter is a little larger than that of the pumping plunger 120. As a result, when the spring plate member 140 is press fitted onto the neck region 108 of the pump housing 102, the plunger 120 passes through the aperture 166 with a sliding clearance.

The lower surface of the lower annular member 160*b* is provided with a downwardly depending annular projection 168, concentric with the aperture 166, which is received into the upper end 132*a* of the biasing spring 132. The projection 168 thus serves as a fixing point for the spring 132 to prevent lateral play between the spring 132 and the spring plate member 140.

The upper annular member 160*a* provides the support means for the locking pin 158 in the form of a lobe 170 that extends slightly outward from the otherwise circular rim of the upper annular member 160*a*. The lobe 170 is provided with an aperture 172 within which the lower end of the locking pin 158 is receivable such that the tip of the locking pin 158 can pass through the aperture 172 and engage the surface of the control arm 143.

By virtue of this arrangement, the locking pin 158 is securely supported against lateral movement, or bending, which avoids loss of calibration accuracy. Furthermore, supporting the locking pin 158 in this way enables the neck region 108 of the pump housing 102 to be formed concentric with the head region 104 which significantly reduces manufacturing complexity and, therefore, unit costs of the fuel pump 100.

It will be appreciated that various modifications may be made to the above described fuel pump without departing from the scope of the invention, as defined by the claims. For example, it is not essential for the spring plate member 140 to be press fit onto the neck region 108 of the pump housing 102. Instead, it may be secured thereon by other means: for example, by welding or by a set screw. Furthermore, although the spring plate member 140 has been described as being a unitary cast component, it should be appreciated that this need not be the case and the spring plate member 140 could be an assembly of two or more parts: for example, a cast, or milled, component for mating with the neck region 108, and for cooperating with the spring 132, and a sheet metal flange for providing support to the locking pin 158. In conclusion, this invention can be embodied in numerous forms. Reference should therefore be made to the appended claims, and not to the foregoing specific description, in determining the broadest scope of the invention.

The invention claimed is:

1. A fuel injection pump comprising:

a pump housing;

a pumping arrangement associated with the pump housing;

wherein the pumping arrangement includes a pumping plunger and a plunger drive arrangement, the pumping plunger having a first end reciprocably received within a plunger bore provided in the pump housing and a second end coupled to the plunger drive arrangement; and a biasing spring having first and second spring ends, the first spring end coupled to a spring plate member associated with the pump housing and the second spring end coupled to the plunger drive arrangement;

wherein the pump housing includes first and second portions aligned on a common axis (A), the first portion including a further bore in which at least an upper portion of a locking pin is receivable and wherein the spring plate member defines a support arrangement for supporting a lower end portion of the locking pin; and wherein the spring plate member comprises first and second axially spaced annular members, each of the first and second axially spaced annular members being provided with a respective aperture.

2. The fuel injection pump of claim 1, wherein the support arrangement is a first aperture provided in the spring plate member, the aperture being shaped for receiving the lower end portion of the locking pin.

3. The fuel injection pump of claim 2, wherein the first aperture is formed in an outwardly projecting lobe provided on the spring plate member.

4. The fuel injection pump of claim 1, wherein one of said apertures receives an end of the pump housing and wherein the other of said apertures receives the pumping plunger.

5. The fuel injection pump of claim 1, wherein the first and second axially spaced annular members define a slot therebetween through which a control arm of the pumping plunger extends.

6. The fuel injection pump of claim 1, wherein the first and second axially spaced annular members are joined by an integral semi-circular wall.

7. The fuel injection pump of claim 1, wherein each of the first portion and the second portion of the pump housing has a substantially uniform diameter along its length, and wherein the diameter of the second portion is smaller than the diameter of the first portion.

8. A fuel injection pump comprising:

a pump housing;

a pumping arrangement associated with the pump housing;

wherein the pumping arrangement includes a pumping plunger and a plunger drive arrangement, the pumping plunger having a first end reciprocably received within a plunger bore provided in the pump housing and a second end coupled to the plunger drive arrangement; and a biasing spring having first and second spring ends, the first spring end coupled to a spring plate member associated with the pump housing and the second spring end coupled to the plunger drive arrangement;

wherein the pump housing includes first and second portions aligned on a common axis (A), the first portion including a further bore in which at least an upper portion of a locking pin is receivable and wherein the spring plate member comprises first and second axially spaced annular members, each of the first and second axially spaced annular members being provided with a respective aperture, one of said apertures receiving an end of the pump housing and the other of said apertures receiving the pumping plunger, and a support arrangement for supporting a lower end portion of the locking pin.

9. The fuel injection pump of claim 8, wherein the support arrangement is a further aperture provided in the spring plate member, the further aperture being shaped for receiving the lower end portion of the locking pin.

10. The fuel injection pump of claim 8, wherein the further aperture is formed in an outwardly projecting lobe provided on the spring plate member.

11. The fuel injection pump of claim 8, wherein the first and second axially spaced annular members define a slot therebetween through which a control arm of the pumping plunger extends.

12. The fuel injection pump of claim 8, wherein the first and second axially spaced annular members are joined by an integral semi-circular wall.

13. The fuel injection pump of claim 8, wherein each of the first portion and the second portion of the pump housing has a substantially uniform diameter along its length, and wherein the diameter of the second portion is smaller than the diameter of the first portion.

* * * * *